US008476528B2

(12) United States Patent
Hodgson et al.

(10) Patent No.: US 8,476,528 B2
(45) Date of Patent: Jul. 2, 2013

(54) ELECTRICALLY INSULATING COATING AND METHOD OF FORMATION THEREOF

(75) Inventors: Simon Hodgson, Middlesborough (GB); Pang Yongxin, Middlesborough (GB)

(73) Assignee: University of Teesside (GB)

( * ) Notice: Subject to any disclaimer, the term of this patent is extended or adjusted under 35 U.S.C. 154(b) by 374 days.

(21) Appl. No.: 12/997,278

(22) PCT Filed: Jun. 10, 2009

(86) PCT No.: PCT/GB2009/050656

§ 371 (c)(1),
(2), (4) Date: Jan. 25, 2011

(87) PCT Pub. No.: WO2009/150463

PCT Pub. Date: Dec. 17, 2009

(65) Prior Publication Data

US 2011/0147040 A1 Jun. 23, 2011

(30) Foreign Application Priority Data

Jun. 10, 2008 (GB) ..... 0810572.8

(51) Int. Cl.
*H01B 7/00* (2006.01)

(52) U.S. Cl.
USPC ..... 174/110 R; 174/110 A

(58) Field of Classification Search
USPC ..... 174/110 R–110 N, 120 R
See application file for complete search history.

(56) References Cited

U.S. PATENT DOCUMENTS

| | | | | |
|---|---|---|---|---|
| 3,707,513 | A * | 12/1972 | Ueno et al. | 526/189 |
| 3,802,913 | A | 4/1974 | MacKenzie, Jr. | |
| 4,471,091 | A * | 9/1984 | Hayashi | 525/71 |
| 4,675,441 | A * | 6/1987 | McEntire et al. | 564/135 |
| 4,942,094 | A | 7/1990 | Okamura et al. | |
| 5,026,889 | A * | 6/1991 | Shiga et al. | 526/142 |

FOREIGN PATENT DOCUMENTS

| | | |
|---|---|---|
| EP | 0460238 | 12/1991 |
| WO | 98/40895 | 9/1998 |

* cited by examiner

*Primary Examiner* — William H Mayo, III
(74) *Attorney, Agent, or Firm* — Marianne Fuierer; Moore & Van Allen, PLLC

(57) ABSTRACT

A method of fabricating a structure comprising the steps of: providing an electrical conductor; providing a layer of a flexible insulating material on the electrical conductor, the material comprising: a first organo-alkoxide $^1R_xSi(O^1R')_{4-x}$ and a second organo-alkoxide $^2R_xSi(O^2R')_{4-x}$, where $^1R$ is a non-hydrolysable organic moiety thermally stable to a temperature of at least 150° C., $^2R$ is a non-hydrolysable organic moiety containing a functional group that can react with another like functional group to form an organic polymer, $^1R'$ and $^2R'$ are alkyl radicals and x is an integer from 0 to 3; and an inorganic filler material.

17 Claims, 5 Drawing Sheets

(a)

(b)

(c)

(a)

(b)

ELECTRICALLY INSULATING COATING AND METHOD OF FORMATION THEREOF

CROSS-REFERENCE TO RELATED APPLICATIONS

This application is filed under the provisions of 35 U.S.C. §371 and claims the priority of International Patent Application No. PCT/GB2009/050656 filed on Jun. 10, 2009, which in turn claims priority of Great Britain Application No. 0810572.8 filed on Jun. 10, 2008, the contents of both applications which are incorporated by reference herein for all purposes.

FIELD OF THE INVENTION

The present invention relates to insulating coatings for electrical conductors and a method of formation thereof. In particular but not exclusively the invention relates to insulating coatings for electrical conductors used in high temperature applications.

More particularly, but not exclusively, the invention relates to insulating coatings for electrical conductors that are required to be subjected to bending and which are capable of withstanding temperatures of 500° C. or more.

BACKGROUND OF THE INVENTION

The development of electrical machines for use in high temperature environments places significant demands on components associated with the machines including a requirement for stability of the materials from which the components are constructed. Environments requiring stability of insulating coatings at high temperature include those associated with nuclear reactors and next generation aircraft motors and generators.

In addition to heat from an environment in which a component is situated, a component may be subject to heat due to other factors such as an electrical current carried by a conductor as well as other stresses. For example, electrical wires used to form windings for motors and generators are subject to particularly harsh thermal and mechanical conditions. The integrity of coatings of such wires is critical to continued successful operation of the motor or generator.

A major barrier restricting the operating temperature of electrical machines is the limited thermal stability of insulation materials applied to the wire from which windings of the machines are formed, as well as the limited stability of insulation materials applied to the windings themselves. Breakdown of insulation materials can occur at excessively high temperatures, or following prolonged exposure of the insulation materials to high temperatures.

The term "high temperature wire" is conventionally used to describe wire insulated with a polymer such as polyimide or polytetrafluoroethylene with a service temperature limited to about 250° C. However, new applications such as those described above may require insulation material that can withstand temperatures of 500° C. or higher. Such temperatures generally preclude the possibility of using organic polymers and therefore the use of inorganic materials has been explored.

U.S. Pat. No. 5,468,557 discloses a method for manufacturing stainless steel clad copper wire coated with an insulator which may be alumina, silica or aluminium nitrite. The insulator is applied to the conductor by means of plasma CVD ion plating. The insulator thickness is limited to around 3 to 4 μm due to brittleness of the insulator material, which limits the breakdown voltage to around 400V.

U.S. Pat. No. 6,876,734 discloses a conductor coated with an insulator composition containing a zirconium compound and a silicon compound which is itself coated with a bonding agent comprising polyamide or polyimide. The high proportion of organic material of the insulator composition imparts good mechanical properties but limits the operating temperature to a maximum of 420° C.

U.S. Pat. No. 5,139,820, EP 0292780 and EP 0460238 disclose conducting wires coated with an insulator formed from alkoxide precursors such as tetraethoxysilane produced by a sol-gel method. U.S. Pat. No. 5,139,820 discloses adding at least one thermoplastic polymer or monomer to the mixture to make the gel extrudable.

STATEMENT OF THE INVENTION

In a first aspect of the present invention there is provided a method of fabricating a structure comprising the steps of:

providing an electrical conductor;

providing a layer of a flexible insulating material on the electrical conductor, the material comprising:

a first organo-alkoxide ${}^{1}R_xSi(O^{1}R')_{4-x}$ and a second organo-alkoxide ${}^{2}R_xSi(O^{2}R')_{4-x}$, where ${}^{1}R$ is a non-hydrolysable organic moiety thermally stable to a temperature of at least 150° C., ${}^{2}R$ is a non-hydrolysable organic moiety containing a functional group that can react with another like functional group to form an organic polymer, ${}^{1}R'$ and ${}^{2}R'$ are alkyl radicals and x is an integer from 0 to 3; and an inorganic filler material.

Thus, a sol-gel derived precursor material being a hybrid sol-gel derived precursor material comprising an organo-silane compound is thereby provided. A hybrid sol-gel precursor comprising an organosilane compound is understood to be a compound comprising silicon which is bonded to at least one non-hydrolysable organic group and 2 or 3 hydrolyzable organic groups.

FIG. 5(*a*) shows an example of a sol-gel silica material, tetraethoxysilane (TEOS). Hydrolysis of this material proceeds according to the equation:

$$Si(OC_2H_5)_4+2H_2O \rightarrow SiO_2(+4C_2H_5OH) \quad 1.1$$

Upon drying, substantial shrinkage occurs (by up to a factor of 100 times or more). Thus a maximum coating thickness of only around 1 um per coating is possible to avoid cracking due to shrinkage.

The sol-gel silica material can be mixed ('filled') with filler particles to reduce shrinkage and increase thickness. However, the material remains too brittle to meet the flexibility requirements of coated wires for the present application.

FIG. 5(*b*) shows an example of a sol-gel organosilane hybrid material methyltrimethoxysilane (MTMS). The material undergoes hydrolysis and forms an inorganic polymer molecule $SiCH_3O_{3/2}$ by a condensation reaction according to the equation:

$$SiCH_3(OCH_3)_3+3/2H_2O \rightarrow SiCH_3O_{3/2}+3CH_3OH \quad 1.2$$

Hydrolysis takes place prior to coating of the wire whilst the condensation reaction takes place primarily during curing of the coating following drying.

In some embodiments the coating following curing may be referred to as a gel or a gel composite or a 'composite', the coating comprising a gel containing inorganic filler particles.

The filler material may comprise particles of a functional filler material providing a secondary deformation mechanism. The particles may be of a specific multi-laminar form and morphology Following curing the wire is bent to a required configuration.

The presence in the precursor material of the additional non-hydrolysable organic moiety $^2R$ containing a functional group that can react with another like functional group to form an organic polymer has the advantage that a resistance of the coating to fracture when flexed following curing may be increased relative to a coating not having this organic moiety. Thus, additional temporary flexibility may be provided to facilitate manufacture of coil windings etc The reaction of this functional group to form a secondary organic polymer bond takes place during the curing process and may facilitate the development of increased coating and/or interfacial bond strength Subsequently, during further heating at or above around 500° C. (which may take place in a furnace or in service), the following reaction takes place whereby the organic group is removed and $SiO_2$ is formed:

$$2CH_3SiO_{3/2}+4O_2 \rightarrow 2SiO_2+3H_2O+2CO_2 \quad 1.3$$

Below 500° C. the hydrolysed material remains capable of deformation to a certain extent without cracking, and certainly deformable to a greater extent than hydrolysed sol-gel TEOS.

It is to be understood that during firing the organic polymer formed by the $^2R$ moieties may decompose. This is typically not a problem since bending of the wire coated by the coating occurs following curing of the coating, i.e. following reaction of the $^2R$ non-hydrolysable organic moieties to form an organic polymer, and before heating of the polymer to in-service temperatures. Thus the organic polymer is present when bending of the wire is performed.

Some embodiments of the invention have the advantage that no separate polymeric material is required to be added to the sol-gel material in order to provide a flexible coating following curing since an organic polymer may be formed directly within the material. This is because the sol-gel material has the second organo-alkoxide bearing the $^2R$ organic moiety.

Because the organic polymer is so formed, it is found to be intimately mixed with the coating following curing. Therefore an extent to which relatively large domains of this polymer form during curing is reduced relative to a process in which mixing of a separately formed polymer material with sol-gel material not having the second organo-alkoxide bearing the $^2R$ organic moiety is performed prior to application of the coating.

This has the advantage that the size of voids formed in the structure when the polymer decomposes at high temperature is greatly reduced. In some embodiments the pore structure may collapse and seal under appropriate conditions thereby preserving the electrical integrity of an insulating layer formed from this material.

Some embodiments of the invention provide an insulated wire which is both capable of being significantly deformed and bent without damage to facilitate winding and assembly of coils in the as manufactured form, and also capable of providing sustained electrical insulation following heat treatment to a temperature in excess of 500° C.

Preferably $^1R$ and $^2R$ are organic radicals containing 1 to 18 carbon atoms.

Preferably $^1R'$ and $^2R'$ are alkyl radicals containing 1 to 4 carbon atoms.

More preferably $^1R$ is one selected from amongst an alkyl group, a fluoroalkyl group and an aryl group.

$^2R$ may be one selected from amongst an epoxy group, a trifluoropropyl group, a chloropropyl group, an aminopropyl group, a phenylethyl group, an acryloyloxypropyl group, a methacryloyloxypropyl group and a glycidyloxylpropyl group.

The step of providing a layer of a precursor material above the electrical conductor may comprise the step of:

providing a mixture comprising the first and second organo-alkoxides, an acid catalyst and a solvent; and hydrolysing the organo-alkoxides.

The step of providing a layer of the precursor material may comprise the step of heating the material. The step of heating of the material may be arranged to cause reaction of the $^2R$ groups thereby to form the organic polymer. Heating may also be arranged to cause condensation of hydrolysed organosilane species thereby to form inorganic polymer. The step of heating of the material may be referred to as a 'curing' process.

The inorganic filler material may comprise at least one selected from amongst alumina, titania and zirconia.

Preferably the inorganic filler material comprises a material having a layered structure, the material being optionally one selected from amongst vermiculite, mica and kaolinite.

In some embodiments of the invention any particulate ceramic material may be used, however in the preferred embodiment, silicate or similar minerals with a layer type crystal structure, having relatively weak interlayer bonding, are used as a significant component of the filler.

Such layered minerals are preferred as the filler particles due to their ability to be readily separated into thin insulating sheets which allow the thickness of the coating to be reduced. Furthermore, the particles impart improved dielectric strength and provide improved mechanical flexibility to the coating. This improved mechanical flexibility is due at least in part to an ability of the particles to slide over one another when the coating is bent.

The use of such filler particles in combination with the sol-gel derived binder allows an insulation coating to be achieved with a breakdown voltage in excess of 1000V at a coating thickness of approximately 20 microns after heat treatment to a temperature in excess of 500° C. The mechanical properties of the coating imparted by the composition allow it to be bent to a radius of less than 4 mm without damage in the condition in which it is applied to a conductor without becoming damaged.

The inorganic filler material may comprise a material having a hardness of substantially 3 or less on the Mohs scale of hardness. Other values of hardness greater than 3 are also useful.

The layer of precursor material may comprise a plurality of component layers.

The layer of precursor material may comprise a first component layer having a first average diameter and a second component layer having a second average diameter, the first average diameter being smaller than the second average diameter.

Optionally the first component layer does not comprise inorganic filler material and the second component layer does comprise inorganic filler material.

Alternatively the first and second component layers may each comprise inorganic filler material.

The first and second component layers may each comprise respective different proportions of the inorganic filler material by weight percent.

Optionally the first layer comprises $^1R$ groups and substantially no $^2R$ groups.

Alternatively the first layer may comprise $^1R$ groups and $^2R$ groups.

The first layer may comprise a greater proportion of $^1R$ groups than $^2R$ groups.

Alternatively the first layer may comprise a greater proportion of $^2R$ groups than $^1R$ groups.

The second layer may comprise $^1R$ groups and $^2R$ groups.

The second layer may comprise a greater proportion of $^1R$ groups than $^2R$ groups.

Alternatively the second layer may comprise a greater proportion of $^2R$ groups than $^1R$ groups.

The first layer may have a thickness in the range from around to 5 to around 40 μm, optionally from around 5 to around 25 μm, preferably from around 5 to around 15 μm.

The second layer may have a thickness in the range from around 5 to around 40 μm, preferably from around 10 to around 30 μm.

A further one or more layers may be provided in addition to the first and second layers.

The precursor layer may comprise a third component layer, the second component layer being provided between the third component layer and the first component layer.

A relative proportion of $^1R$ groups and $^2R$ groups in the first, second and third component layers is arranged to vary as a function of average distance of the respective component layer from the wire.

In some embodiments the third layer contains a greater proportion of $^2R$ groups with respect to $^1R$ groups than the second layer. In some embodiments, the second layer in turn contains a greater proportion of $^2R$ groups with respect to $^1R$ groups than the first layer. As discussed above the first layer may contain substantially no $^2R$ groups.

A ratio of thicknesses of the first component layer:second component layer:third component layer may be around 1:3:2. In some embodiments the ratio is substantially 1:2:3. Other ratios are also useful.

The electrical conductor may comprise a wire member.

The wire member may comprises at least one selected from amongst nickel, copper, nickel coated copper, silver coated copper, stainless steel and invar wire.

The layer of precursor material may comprise from 1 to 30 percent by mass of said inorganic filler particles having an average particle diameter between around 0.01 and 10 microns; and 30 to 95 percent by mass of organic solvents.

Preferably at least a portion of the layer of the precursor material is formed by passing the conductor through a bath of precursor material.

This has the advantage that a uniform coating may be obtained in a relatively rapid manner.

Preferably the electrical conductor is coated in precursor material in a substantially continuous manner.

This has the advantage that the method is compatible with large-scale industrial manufacturing processes.

The method may further comprise the step of subjecting the structure to a drying process whereby a quantity of solvent is removed from the layer.

The method preferably comprises the step of subjecting the structure to a curing process whereby the structure is heated to a temperature in the range from around 150° C. to around 350° C., optionally from around 200° C. to around 350° C., further optionally from around 220° C. to around 320° C.

The method may further comprise the step of firing the structure at a temperature of from around 350° C. to around 800° C.

$^1R$ may be selected to be a non-hydrolysable organic moiety thermally stable to a temperature of at least 200° C., preferably a temperature between 200° C. and 500° C., optionally a temperature between 300° C. and 500° C.

$^2R$ may be a non-hydrolysable organic moiety containing a functional group that can react with another like functional group to form an organic polymer by one selected from amongst polymerisation, copolymerisation and polycondensation.

In a second aspect of the invention there is provided a structure comprising:

an electrical conductor;

a layer of a flexible insulating material above the electrical conductor, the material comprising:

a first organo-alkoxide $^1R_xSi(O^1R')_{4-x}$ and a second organo-alkoxide $^2R_xSi(O^2R')_{4-x}$, where $^1R$ is a non-hydrolysable organic moiety thermally stable to a temperature of at least 150° C., $^2R$ is a non-hydrolysable organic moiety containing a functional group that can react with another like functional group to form an organic polymer, $^1R'$ and $^2R'$ are alkyl radicals and x is an integer from 0 to 3; and an inorganic filler material.

Preferably $^1R$ and $^2R$ are organic radicals containing 1 to 18 carbon atoms.

Preferably $^1R'$ and $^2R'$ are alkyl radicals containing 1 to 4 carbon atoms.

$^1R$ may be one selected from amongst an alkyl group, a fluoroalkyl group and an aryl group.

$^2R$ may be is one selected from amongst an epoxy group, a trifluoropropyl group, a chloropropyl group, an aminopropyl group, a phenylethyl group, an acryloyloxypropyl group, a methacryloyloxypropyl group and a glycidyloxylpropyl group.

BRIEF DESCRIPTION OF THE DRAWINGS

Embodiments of the invention will now be described with reference to the accompanying figures in which.

DETAILED DESCRIPTION

Figure 1:
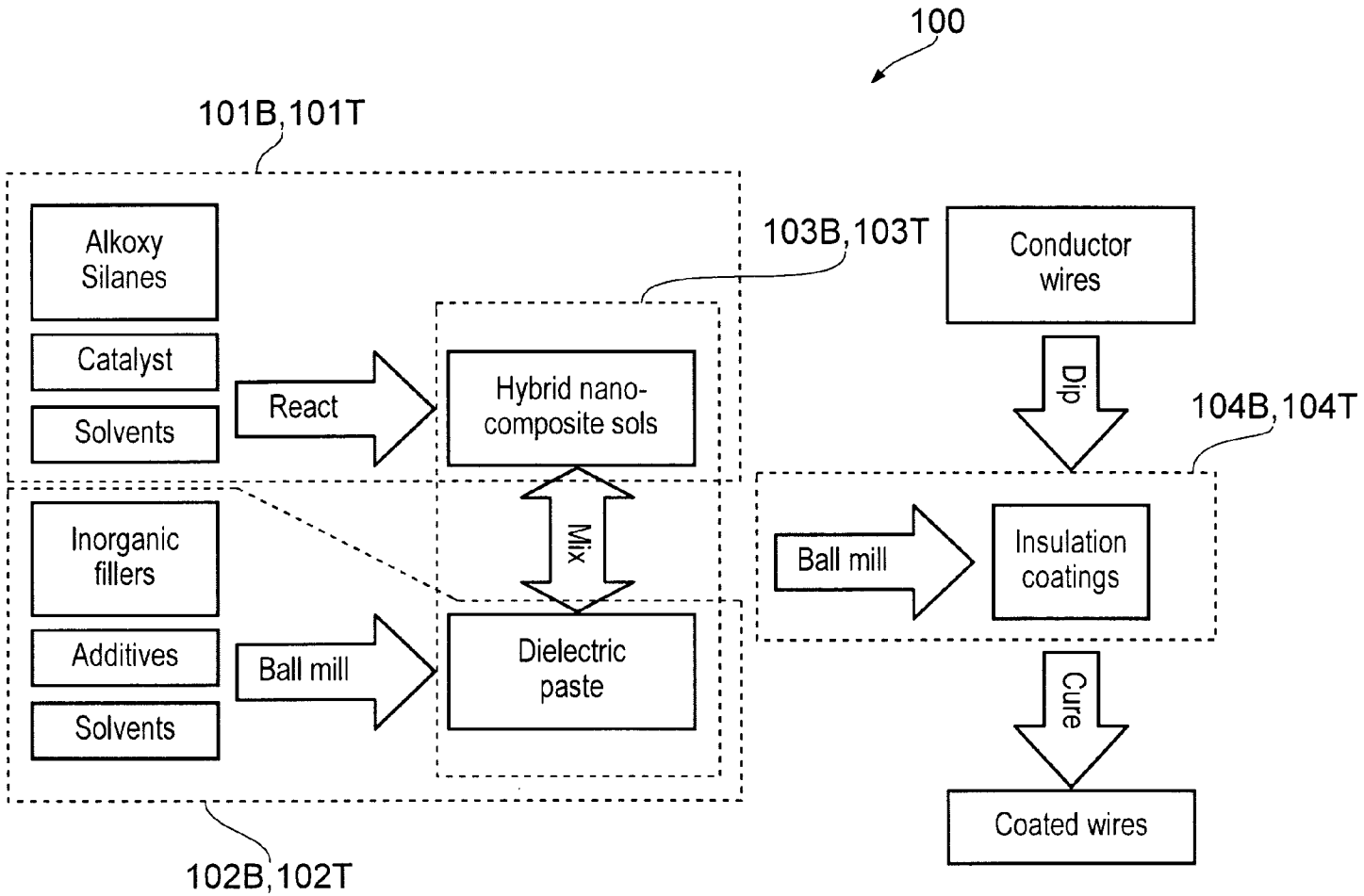
FIG. 1 is a schematic diagram of a process of forming an insulated wire according to an embodiment of the invention.

In one embodiment of the invention electrical wire having a ceramic insulation coating was produced by the process steps illustrated schematically in FIG. 1. In this embodiment the electrical wire is formed from nickel-coated copper. Other materials are also useful including copper, nickel, iron, stainless steel, silver-coated copper and alloy wires such as Invar wire.

Two different insulator layer formulations were produced, a base layer insulator formulation and a top layer insulator formulation. The base layer insulator formulation was applied to a wire member 10 not having a coating thereon (FIG. 2) to form a base insulator layer 12. The top layer insulator formulation was applied to the base insulator layer 12 to form a top insulator layer 14.

In some embodiments of the invention both the base layer insulator formulation and the top layer insulator formulation comprise:

(a) 5 to 40 percent by mass of a hybrid sol-gel material comprising a first organo-alkoxide $^1R_xSi(O^1R')_{4-x}$ and a second organo-alkoxide $^2R_xSi(O^2R')_{4-x}$, where $^1R$ is a non-hydrolysable organic moiety thermally stable to a temperature of at least 150° C., $^2R$ is a non-hydrolysable organic moiety containing functional groups which can react to form an organic polymer, $^1R'$ and $^2R'$ are alkyl radicals and x is an integer from 0 to 3;

(b) 0 to 30 percent by mass of high dielectric constant inorganic filler particles having an average particle diameter between around 0.01 and 10 microns; and (c) 30 to 95 percent by mass of organic solvents, chosen such that the proportions of (a), (b) and (c) sum to substantially 100 percent by mass.

Figure 4:
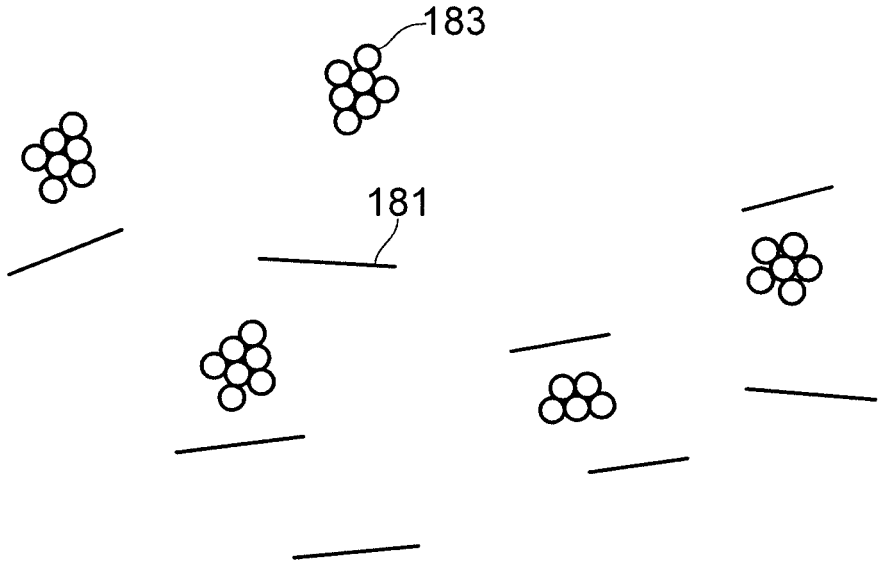
FIG. 4 shows a process by which an organic-inorganic hybrid nanocomposite precursor layer is formed and subsequently heated to elevated temperature.
Figure 4:
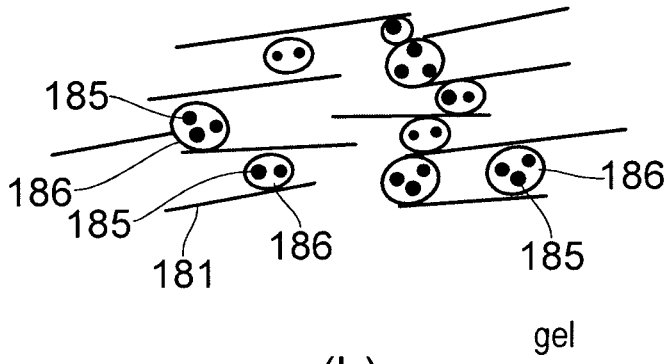
Figure 4:
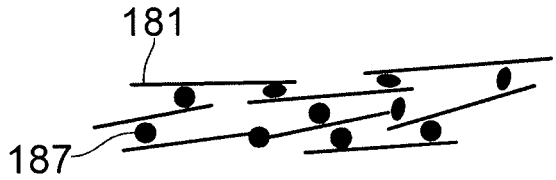
Figure 5:
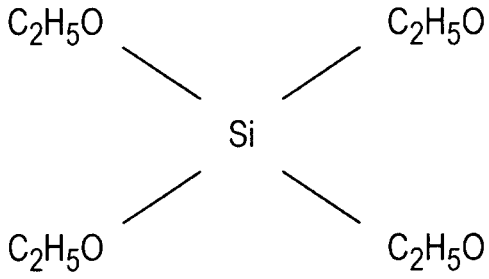
FIG. 5 shows (a) an example of a sol-gel silica-containing material, tetraethoxysilane (TEOS) and (b) an example of a sol-gel organosilane hybrid material methyltrimethoxysilane (MTMS).
Figure 5:
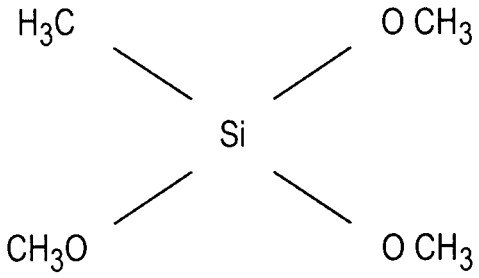

The formulation is shown schematically in FIG. 4(*a*) in which inorganic filler particles 181 are seen suspended in a mixture comprising the hydrolysed and/or partially-hydrolised products 183 of the first and second organo-alkoxides and solvent. The formulation is applied to the wire and cured. During the curing process, condensation of the products 183 takes place to form the organic moiety-containing polysiloxane which may also be referred to as an inorganic polymer.

In addition polymerisation of the functional groups of the $^2R$ non-hydrolysable organic moiety takes place during curing to form an organic polymer.

It is to be understood that the inorganic filler particles are advantageously selected to have a characteristic layered structure in order to provide improved insulation and flexibility of the coating.

The wire is typically a nickel coated copper wire, the nickel providing a suitable substrate for the coating. Deposition directly onto copper can result in poor adhesion of the coating to the wire due to oxidation of the surface of the copper wire.

During the curing process particles of an organic-inorganic hybrid nanocomposite 185 are formed as shown in FIG. 4(*b*). The term 'nano' refers to a size of the hybrid molecules so formed.

The hybrid nanocomposite 185 comprises organic moiety-containing polysiloxane, where a portion of the organic moieties are in the form of organic polymer formed from the functional groups associated with the second organo-alkoxide. In some embodiments the particles of the nanocomposite 185 agglomerate to form larger agglomerates of particles 186.

The nanocomposite particles 185 form bridges between the inorganic filler particles 181 during the curing process as described above and illustrated in FIG. 4(*b*).

The presence of the organic polymer particles 186 facilitates bonding and sliding of the platelets lending flexibility to the coating and enhancing a resistance of the coating to fracture.

In some embodiments the nanocomposite 185 agglomerates to form a continuous matrix during curing, with the inorganic filler particles 181 dispersed therein.

Subsequently, either in a further processing step or in service, the wire is heated (in some embodiments this may be described as a 'firing' process) to a temperature in the range from around 150° to around 500° C. and the organic polymer decomposes ('burns off'). Thus out-gassing takes place. In some embodiments at least some organic moieties from the first organo-alkoxide remain following firing, depending on a temperature to which the structure has been heated during firing. The presence of the organic moieties increases a thermal expansion coefficient of the structure such that the thermal expansion coefficient is more closely matched to that of the wire underlying the coating. In the case that the first organo-alkoxide consists of or comprises MTMS, the organic moieties may be methyl groups.

During firing at a temperature above 500° C., the following reaction takes place whereby $SiO_2$ 187 is formed using $^1R{=}CH_3$ as an example:

$$2CH_3SiO_{3/2}+4O_2 \rightarrow 2SiO_2+3H_2O+2CO_2 \qquad 1.4$$

Thus, $SiO_2$ 187 (FIG. 4(*c*)) remains following firing, the material being arranged to form bridges between inorganic filler particles as shown in the figure. The use of filler particles having a layered structure lends resistance to fracture even in the absence of polymer since the particles are capable of experiencing internal deformation/sliding in order to relieve stresses to which the particles may be subjected without fracture.

Example 1

Base Insulator Layer Formulation

In the base layer formulation, the composition is optimised such that after curing the layer has a lower polymer content than that of a layer above the base layer. This feature enables a reduction in the amount of shrinkage of the base layer and the amount of gas evolved during heating following curing which typically occurs to much higher temperatures in service. The shrinkage and gas evolution (out-gassing) otherwise inhibits effective bonding of the base layer to the wire and/or of the base layer to a layer above the base layer.

It is to be understood that the reduced organic content of the base layer simultaneously reduces the flexibility of the base layer. In some embodiments the thickness of the base layer should therefore be precisely controlled (typically to a within a few microns) in order to allow the requisite mechanical properties to be achieved.

In step 101B (FIG. 1) a hybrid nano-composite sol was produced by mixing an alkoxy-silane (54.4 g of methyltrimethoxysilane, MTMS) with an acid catalyst (0.8 g of phosphomolybdic acid) and a mixture of solvents (16 g of diacetone alcohol, 8 g of toluene and 14.4 g of water). The components were stirred in a flask at 65° C. for 5 hours.

Other catalysts are useful instead of or in addition to phosphomolybdic acid including but not limited to phosphoric acid, boric acid, tungstic acid, phosphotungstic acid and molybdic acid. In general, for the purpose of forming insulator formulations according to some embodiments of the invention the catalyst is chosen on the basis that it may be converted into an oxide upon heating to high temperature. The catalyst may also impart a fluxing function to assist in sealing of porosity during heat treatment.

In step 102B an inorganic filler material (11.5 g of vermiculite) was mixed with an additive (0.2 g of acetic acid) and 27 g of a mixed solvent (42.5% diacetone alcohol, 42.5% toluene and 15% isopropanol). The resulting composition was ball milled for 24 hours to form a dielectric paste.

The hybrid nanocomposite sol and dielectric paste were subsequently mixed (step 103B) and ball milled (step 104B) for a further 24 hours to form a base insulator formulation in the form of a sol-gel.

Example 2

Top Layer Insulator Formulation

In step 101T (FIG. 1) a hybrid nano-composite sol was produced by mixing an alkoxy-silane (43.5 g of MTMS, 18.9 g of glycidyloxypropyltrimethoxysilane, GPTMS), an acid catalyst (0.8 g of phosphomolybdic acid) and a mixed solvent (16 g of diacetone alcohol, 8 g of toluene and 14.4 g of water).

The components were stirred in a flask at 65° C. for 8 hours followed by stirring at ambient temperature for 24 hours to form a hybrid nanocomposite sol.

In step 102T an inorganic filler material (16.3 g of vermiculite) was mixed with an additive (0.27 g of acetic acid) and 38 g of a mixed solvent 38 g (57% diacetone alcohol and 43% toluene). The resulting composition was ball milled for 24 hours to form a dielectric paste.

The hybrid nanocomposite sol and dielectric paste were subsequently mixed and ball milled for a further 24 hours to form the top layer insulator formulation in the form of a sol-gel.

In one embodiment of the invention a nickel-plated copper wire is subjected to a coating step in which the wire is coated with base layer insulator formulation by passing the wire through a bath of the formulation. In some embodiments the wire is subjected to the coating step using an automated reel-to-reel coating system having a drying stage and a curing stage. Thus, continuous lengths of insulated wires may be formed.

The purpose of the drying stage is to remove excess solvent from the coating. In some embodiments in the drying stage coated wire is passed through a tunnel in the presence of a counter flow of hot air.

The purpose of the curing stage is at least in part to drive remaining solvent residue out from the coated wire. The curing stage involves heating the dried coated wire to a prescribed temperature for a prescribed period of time in order to increase the mechanical strength of the coating as described above. Following the curing stage the coated wire may typically be handled and wound without damaging the coating.

The coated wire may be used to fabricate a winding or other article, prior to being subjected to heating to a temperature of from around 350° C. to around 800° C. The firing process removes organic components present in the coating and results in a completion of the polycondensation reaction of the precursor layer. In some embodiments firing of the wire is performed in a furnace. In some alternative embodiments firing is not performed in a furnace. Instead, removal of the organic components and/or further polycondensation may occur during service of the coated wire.

In some embodiments the drying stage involves the step of flowing hot air over the coated wire at a temperature of around 60° C. Other temperatures are also useful. Other drying methods are also useful.

In some embodiments the curing stage involves the step of heating the wire to a temperature of from around 220° C. to around 320° C.

In some embodiments the nickel-coated copper wire has a diameter of around 1.2 mm and the coating step involves the formation of a base insulator coating around the wire that is around 18 microns in thickness. In some embodiments the wire is subject to the coating step more than once in order to build up a base insulator layer 12 of a required thickness.

Other thicknesses of base insulator layer 12 are also useful. Other diameters of the nickel-coated copper wire are also useful. Other materials are also useful for forming the wire.

Once the base insulator layer 12 has been formed over the wire member 10, the top insulator layer 14 is formed over the base insulator layer in a similar manner. In some embodiments, the two-stage drying and curing process is performed in a similar manner to that described above except that the curing stage involves the step of heating the wire to a temperature in the range from around 180° C. to around 260° C. Other temperature ranges are also useful.

In some embodiments the base insulator layer is around 18 microns in thickness and the top insulator layer is around 12 microns in thickness. In some such embodiments and in some other embodiments a wire member having a base insulator layer and a top insulator layer as described can be bent around a mandrel such that a bend having an inner radius of 5 mm or less can be formed without damaging the coating. Such a wire can withstand temperatures in excess of 500° C. with a breakdown voltage after firing at 500° C. that is greater than 1100 Volts.

In the examples described above and in some other embodiments of the invention having two or more coatings of insulator material, a layer of insulator provided over another layer of insulator (i.e. an outer layer of the two) is arranged to have increased flexibility relative to a layer below that layer (i.e. an inner layer of the two). This is because for a given radius of bend of the conductor, portions of the outer layer will experience a compressive or tensile stress of greater magnitude than corresponding portions of the inner layer and will therefore be subject to a greater amount of tensile or compressive deformation.

Figure 2:
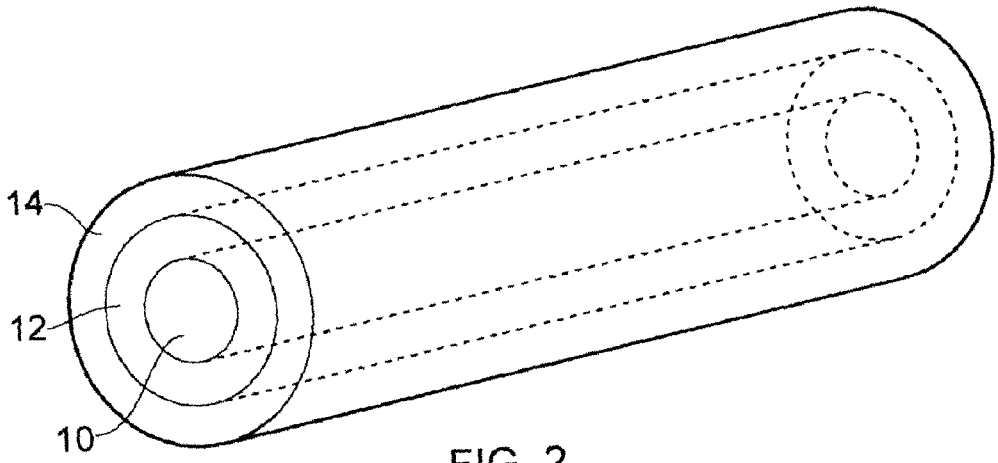
FIG. 2 is a schematic diagram of an insulated wire according to an embodiment of the invention.
Figure 3:
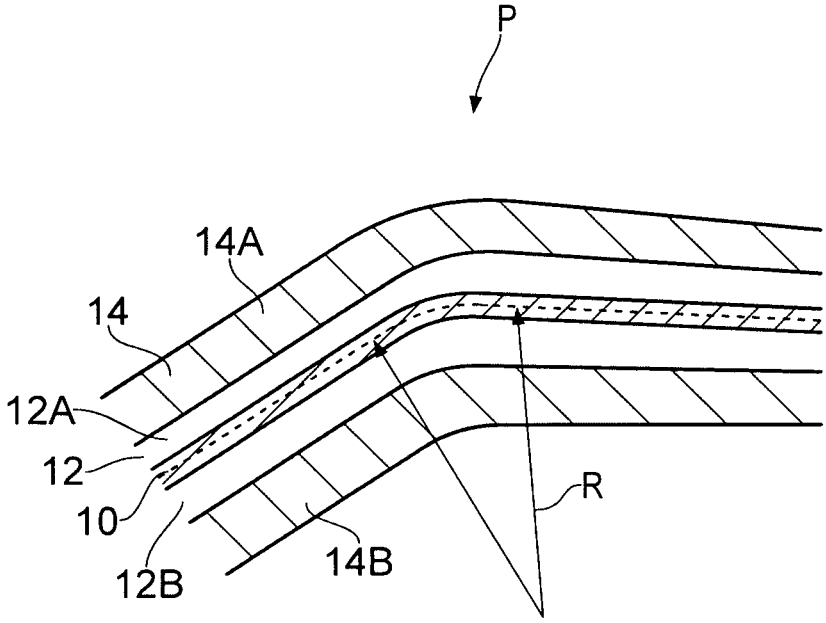
FIG. 3 shows a cross-sectional view of the wire of FIG. 2 in a bent condition.

This phenomenon is illustrated in FIG. 3. In FIG. 3 the conducting wire member 10 of FIG. 2 is shown having a portion P having a bend formed therein. Base layer 12 and top layer 14 are bent in a corresponding manner. It is to be understood that, with respect to the radius of bending R of the portion P of the conducting wire member 10. A radially outer region 14A of the top layer 14 is subjected to a greater amount of tensile strain than a radially outer region 12A of the base layer 12. Similarly, a radially inner region 14B of the top layer 14 is subjected to a greater amount of compressive strain than a radially inner region 12B of the base layer 12.

If the wire is twisted, it will be understood that an amount of deformation of a given layer due to twisting will also increase as a function of radial distance of a given layer from the wire member 10.

In order to accommodate the difference in tensile, compressive and other strains (such as shear strains) between outer and inner layers of the insulator, in some embodiments of the invention the relative amounts of a given R group associated with a given layer changes as a function of radial position of the layer.

Thus, in some embodiments a larger amount of second alkoxide (bearing $^{2}$R organic moeties) is provided in formulation used to provide an upper layer of the coating relative to the amount of first alkoxide (bearing $^{1}$R organic moeties) use to form a lower layer of the coating.

In some embodiments an increased amount of an R group of larger size relative to the amount of an R group of smaller size is provided in a given layer to increase a flexibility of that layer. Thus, the presence of increasing amounts of a larger R group relative to the amount of a smaller R group may be provided in a given layer, the amount increasing for successive layers from an inner layer outwards.

In the above examples, the base layer 12 (example 1) is formed to have a silane having only the smallest R group (methyl group) since it is formed by mixing an alkoxy-silane being MTMS with acid catalyst and solvent.

The top layer 13 (example 2) (or second layer) is formed to have a silane comprising an amount of a larger R group such as glycidyloxypropyl. In example 2 the second layer has around 25 mol % of the methyl groups substituted by glycidyloxypropyl groups. In other words, the R groups are provided by a mixture of around 75 mol % MTMS and 25 mol % GPTMS.

In some embodiments a third layer is provided. In some embodiments the third layer has a greater proportion of glycidyloxypropyl groups compared with the second layer. In some embodiments R groups of the third layer are formed from a mixture comprising around 40 mol % GPTMS and 60 mol % MTMS.

In some embodiments a mixture containing even larger R groups is used. In some embodiments the mixture of R groups contains methacryloyloxypropyl. In some such embodiments the mixture of R groups in the second or third layer contains around 75 mol % MTMS and 25 mol % methacryloyloxypropyltrimethoxysilane.

In this manner a spectrum of coating materials can be formulated and applied to conductors to form an insulation structure with layers having a mechanical flexibility that increases as a function of radial distance of the respective layers from a central conductor.

In some embodiments the thickness of the base insulator layer 12 is in the range from around 2 to around 25 μm, preferably in the range from around 5 to around 15 μm.

In embodiments having three layers, the thickness of a middle layer being a layer between the base layer and top layer may be formed to have a thickness in the range from around 6 to around 40 μm, preferably in the range from around 15 to around 30 μm. The top layer may be formed to have a thickness in the range from around 5 to around 30 μm, preferably from around 10 to around 20 μm. The ratio of thickness of the base layer to the middle layer to the top layer is preferably around 1:3:2. Other ratios are also useful, such as 1:2:3 or any other suitable ratio.

Example 3

In one embodiment having an insulator layer comprising three component layers the base layer coating comprises 70 wt % of nanocomposite sol made from MTMS and 30 wt % of particulate filler. The middle layer comprises 40 wt % of particulate filler and 60 wt % of nanocomposite sol made from 80 mol % of MTMS and 20 mol % of GPTMS. The top layer comprises 40 wt % of particulate filler and 60 wt % of nanocomposite sol made from 70 mol % of MTMS, 20 mol % of GPTME and 10 mol % of methacryloyloxypropyltrimethoxysilane. It is to be understood that the relative proportions of the different constituents of the three layers may be varied in order to optimise the properties of the coatings for a given application.

In some embodiments a cross-section of an electrical wire is generally circular and a diameter or radius of the wire can be readily defined. In some embodiments the cross-section is not circular and may instead be any suitable shape including generally square, oblong, elliptical or any other shape. It is to be understood that in such embodiments an average radius or diameter may be defined being an average distance of an outer surface of the wire from a centroid of the cross-section, or any other suitable reference position.

Throughout the description and claims of this specification, the words "comprise" and "contain" and variations of the words, for example "comprising" and "comprises", means "including but not limited to", and is not intended to (and does not) exclude other moieties, additives, components, integers or steps.

Throughout the description and claims of this specification, the singular encompasses the plural unless the context otherwise requires. In particular, where the indefinite article is used, the specification is to be understood as contemplating plurality as well as singularity, unless the context requires otherwise.

Features, integers, characteristics, compounds, chemical moieties or groups described in conjunction with a particular aspect, embodiment or example of the invention are to be understood to be applicable to any other aspect, embodiment or example described herein unless incompatible therewith.

The invention claimed is:

1. A method of fabricating an electrical conductor having an insulating coating, the method including the steps of:

providing the electrical conductor;

coating the electrical conductor with at least one layer of a flexible insulating percursor material on the electrical conductor, the percursor material comprising:

a first organo-alkoxide $^1R_xSi(O^1R')_{4-x}$, a second organo-alkoxide $^2R_xSi(O^2Ry_x$ and an inorganic filler material, where $^1R$ is a non-hydrolysable organic moiety thermally stable to a temperature of at least 150° C., $^2R$ is a non-hydrolysable organic moiety containing a functional group that can react with another like functional group to form an organic polymer[1], wherein R' and $^2R'$ are alkyl radicals and x is 1 or 2.

2. The method as claimed in claim 1 wherein $^1R$ and $^2R$ are organic radicals containing 1 to 18 carbon atoms, wherein $^1R$ is selected from the group consisting of an alkyl group, a fluoroalky group and an aryl group, and wherein $^2R$ is selected from the group consisting of an epoxy group, an acryloyloxypropyl group, a methacryloyloxypropyl group and a glycidyloxylpropyl group.

3. The method as claimed in claim 2 wherein $^1R'$ and $^2R'$ are alkyl radicals containing 1 to 4 carbon atoms.

4. The method as claimed in claim 1 wherein the step of coating the electrical conductor with the percusor material comprises the step of: providing a mixture comprising the first and second organo-alkoxides, an acid catalyst and a solvent contacting the electrical conductor with the mixture and subsequently hydrolysing the first organo-alkoxide to form a hydrolysed organosilane species.

5. The method as claimed in claim 3 wherein the coating step of is followed by the step of heating the precursor material thereby to cure the material through condensation of hydrolysed organosilane species thereby to form an inorganic polymer and to form organic polymer by reaction of the $^2R$ groups.

6. The method as claimed in claim 1 wherein the inorganic filler material comprises at least one selected from amongst silica, alumina, titania and zirconia, vermiculite, mica or kaolinite.

7. The method as claimed in claim 1 wherein at least one layer of precursor material comprises a plurality of component layers, wherein said at least one layer of precursor material comprises a first component layer being an inner layer and a second component layer positioned on the inner layer.

8. The method as claimed in claim 7 wherein the layer of precursor material comprises first and second component layers each comprising respective different proportions of the inorganic filler material by weight percent and optionally wherein the first component layer does not comprise inorganic filler material and the second component layer does comprise inorganic filler material.

9. The method as claimed claim 7 wherein the first layer comprises $^1R$ groups and substantially no $^2R$ groups or wherein the first layer comprises $^1R$ and $^2R$ groups and/or wherein the second layer comprises $^1R$ groups and $^2R$ groups.

10. The method as claimed in claim 7 wherein a further one or more layers are provided in addition to the first and second layers.

11. The method as claimed in claim 7 wherein the precursor layer comprises a third component layer, the second component layer being provided between the third component layer and the first component layer, and wherein a relative proportion of $^1R$ groups and $^2R$ groups in the first, second and third component layers is arranged to vary as a function of average distance of the respective component layer from the electrical conductor.

12. The method as claimed in claim 1 further comprising the step of subjecting the electrical conductor to a drying process whereby a quantity of solvent is removed from the layer.

13. The method as claimed in claim 1 comprising the step of subjecting the electrical conductor to a curing process whereby the structure is heated to a temperature in the range from around 150° C. to around 350° C., optionally from around 200° C. to around 350° C., further optionally from around 220° C. to around 320° C.

14. The method as claimed in claim 1 further comprising the step of firing the structure at a temperature of from around 350° C. to around 800° C.

15. A percursor structure for an electrical conductor having an insulating coating comprising:

an electrical conductor;

at least one layer of a flexible insulating precursor material above the electrical conductor, the percursor material comprising: a first organo-alkoxide $^1R_xSi(O^1R')_{4-x}$, a second organo-alkoxide $^2R_xSi(O^2R)_{4-x}$ and an inorganic filler material where $^1R$ is a non-hydrolysable organic moiety thermally stable to a temperature of at least 150° C., $^2R$ is a non-hydrolysable organic moiety containing a functional group that can react with another like functional group to form an organic polymer, $^1R'$ and $^2R'$ are alkyl radicals and x is 1 or 2.

16. The structure as claimed in claim 15 wherein $^1R$ and $^2R$ are organic radicals containing 1 to 18 carbon atoms, wherein $^1R$ is selected from the group consisting of an alkyl group, a fluoroalky group and an aryl group, and wherein $^2R$ is selected from the group consisting of an epoxy group, an acryloyloxypropyl group, a methacryloyloxypropyl group and a glycidyloxylpropyl group or wherein $^1R'$ and $^2R'$ are alkyl radicals containing 1 to 4 carbon atoms.

17. A structure comprising an electrical conductor having a layer of an insulating material provided thereon, the insulating layer comprising inorganic filler particles bound together by means of a $SiO_2$ based binder material derived from decomposition of organo-alkoxides according to a reaction of the form $$ARSiO_3Z_2+BO_2 \rightarrow CSiO_2+DH_2O+ECO_2$$

or similar, where A, B, C, D and E depend on the nature of the organic precursor R.

* * * * *